US007441720B2

(12) United States Patent
Marzaro et al.

(10) Patent No.: US 7,441,720 B2
(45) Date of Patent: Oct. 28, 2008

(54) ICE-CRUSHER

(75) Inventors: Nereo Marzaro, Campo San Martino (IT); Stefano Zambon, Campo San Martino (IT); Daniele Bonato, Campo San Martino (IT)

(73) Assignee: Sirman S.p.A., Campo San Martino (IT)

( * ) Notice: Subject to any disclaimer, the term of this patent is extended or adjusted under 35 U.S.C. 154(b) by 785 days.

(21) Appl. No.: 10/945,254

(22) Filed: Sep. 20, 2004

(65) Prior Publication Data

US 2005/0087635 A1 Apr. 28, 2005

(30) Foreign Application Priority Data

Sep. 22, 2003 (IT) ..... VI2003A0181

(51) Int. Cl.
*B02C 17/02* (2006.01)

(52) U.S. Cl. ..... 241/92; 241/286; 241/DIG. 17

(58) Field of Classification Search ..... 241/DIG. 17, 241/92, 286, 33, 37.5
See application file for complete search history.

(56) References Cited

U.S. PATENT DOCUMENTS 2,398,933 A 4/1946 Grant
2,610,803 A * 9/1952 Bayston ..... 241/259.1
2,648,203 A 9/1953 Heuser et al.
2,865,571 A 12/1958 Ferdon
2,905,397 A 9/1959 De Angelis et al.
3,098,613 A 7/1963 Hellyer
3,415,457 A * 12/1968 Echols, Jr. ..... 241/92
3,534,915 A 10/1970 Clark
4,113,190 A * 9/1978 Fudman ..... 241/92
4,589,599 A 5/1986 Williams et al.
5,261,469 A * 11/1993 Severson ..... 144/176

OTHER PUBLICATIONS

European Search Report, Aug. 25, 2006.

* cited by examiner

*Primary Examiner*—Faye Francis
(74) *Attorney, Agent, or Firm*—James V. Costigan; Hedman & Costigan, P.C.

(57) ABSTRACT

An ice-crusher (10) comprises a grinding hole (15) which includes a feeding collar (16) to which a lever (18) is hinged to push ice into the cutting area; the cutting unit includes a rotating disc (23) to which a cutting blade (25) is attached. The distance of the cutting blade (25) from the disc (23) can be set axially by the user and from outside the covering (13) of the ice-crusher (10) by means of a regulating key to break up ice into pieces of different thickness. Moreover, the manifold motor (34) of the device is positioned horizontally and is staggered relative to the shaft (26). Said motor (34) transmits motion to the shaft (26) by means of a belt (39) to leave room for inserting into the device (10) the key for regulating the thickness.

6 Claims, 7 Drawing Sheets

ICE-CRUSHER

The present invention refers to an ice-crusher which can be used either at home or professionally and be useful in kitchens, hotels, restaurants, guesthouses and communities in general.

At present a great number of domestic and industrial apparatus is available which can be used to prepare and treat foods, e.g. beaters, blenders, slicers, meat choppers, juicers, mixers, etc.

In time, these apparatus have become more and more versatile and reliable, in particular with regard to the possibility of carrying out several operations with one multifunction device.

However, most tools used in apparatus for preparing and treating foods do not provide optimum functionality. For example, in the case of ice-crushers, conventional apparatus usually comprise a grinding hole made of melted aluminium, the hopper of the grinding hole including a semicircle feeding collar to the top of which a lever is hinged which pushes ice towards a cutting unit. The cutting unit includes a rotating disc to which a cutting blade is attached, said cutting blade being integral with a driving shaft horizontally positioned relative to the machine, whereas the product is released through an opening at the bottom of the grinding hole.

However, prior art devices do not permit to grind ice with different kinds of thickness, consistency and size, as requested in the last few years on the market; as known, the request is getting more and more widespread to use one single device to break up ice into pieces of different size and thickness, from the most small pieces (mainly requested to prepare water-ice) to the thickest and most consistent pieces (particularly used to prepare cocktails and to present some products and courses, such as those based on fresh fish).

Therefore, the general object of the present invention is to solve the above mentioned technical problems of prior art devices in a new, extremely simple, cheap and particularly functional way. In particular, the object of the invention is to provide an ice-crusher which permits to break up ice into pieces of different size and thickness by using a single tool.

Another object of the present invention is to provide an ice-crusher which permits to protect the drive motor against the possible seepage of water from the cutting unit and against the mechanical stresses produced by the ice blocks being ground, which usually compromise the normal motor life.

A further object of the present invention is to provide a particularly effective, handy and safe ice-crusher which, due to the achieved advantages, is extremely small and involves considerably reduced production costs relative to conventional ice-crushers.

These and other objects are provided by means of an ice-crusher according to claim 1, which is referred to for the sake of brevity; other technical features of the apparatus are set out in the alleged dependent claims.

The structural and functional features of the present invention and the advantages thereof with respect to prior art will become even clearer from the following description, with reference to the accompanying drawings, in which.

Figure 1:
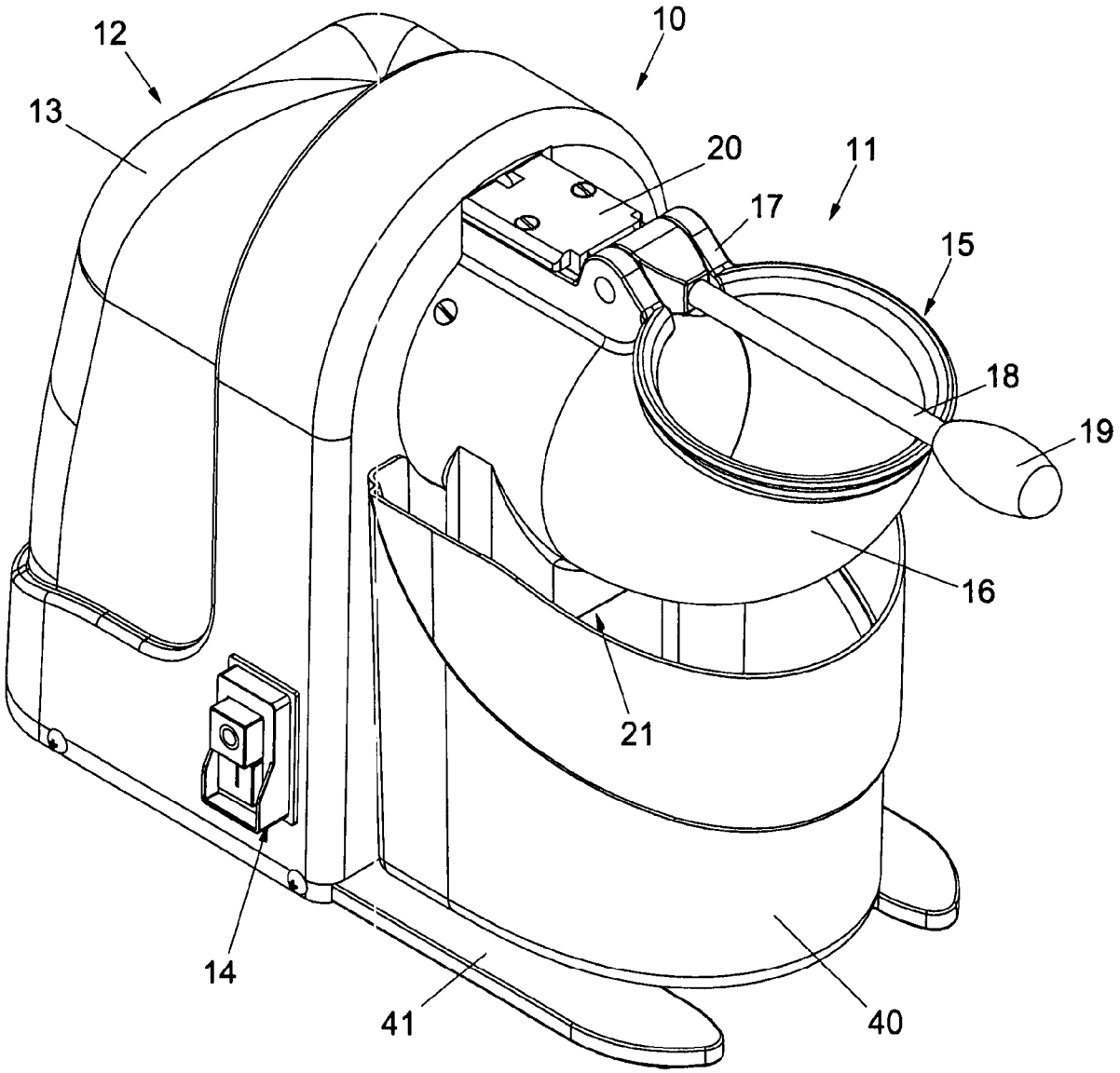
FIG. 1 shows a first axonometric view of the ice-crusher according to the present invention.
Figure 2:
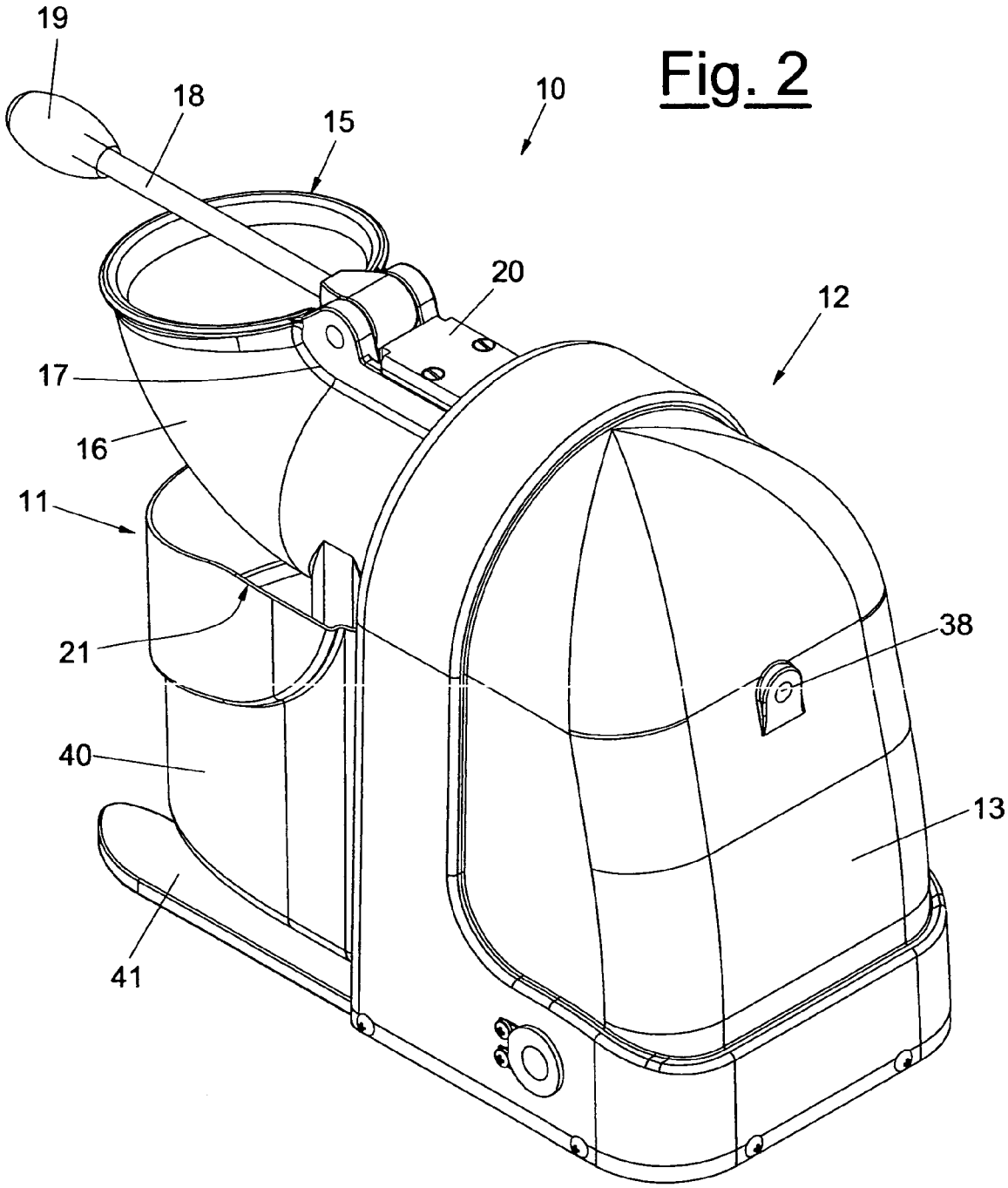
FIG. 2 is a second axonometric view of the ice-crusher according to the present invention.
Figure 3:
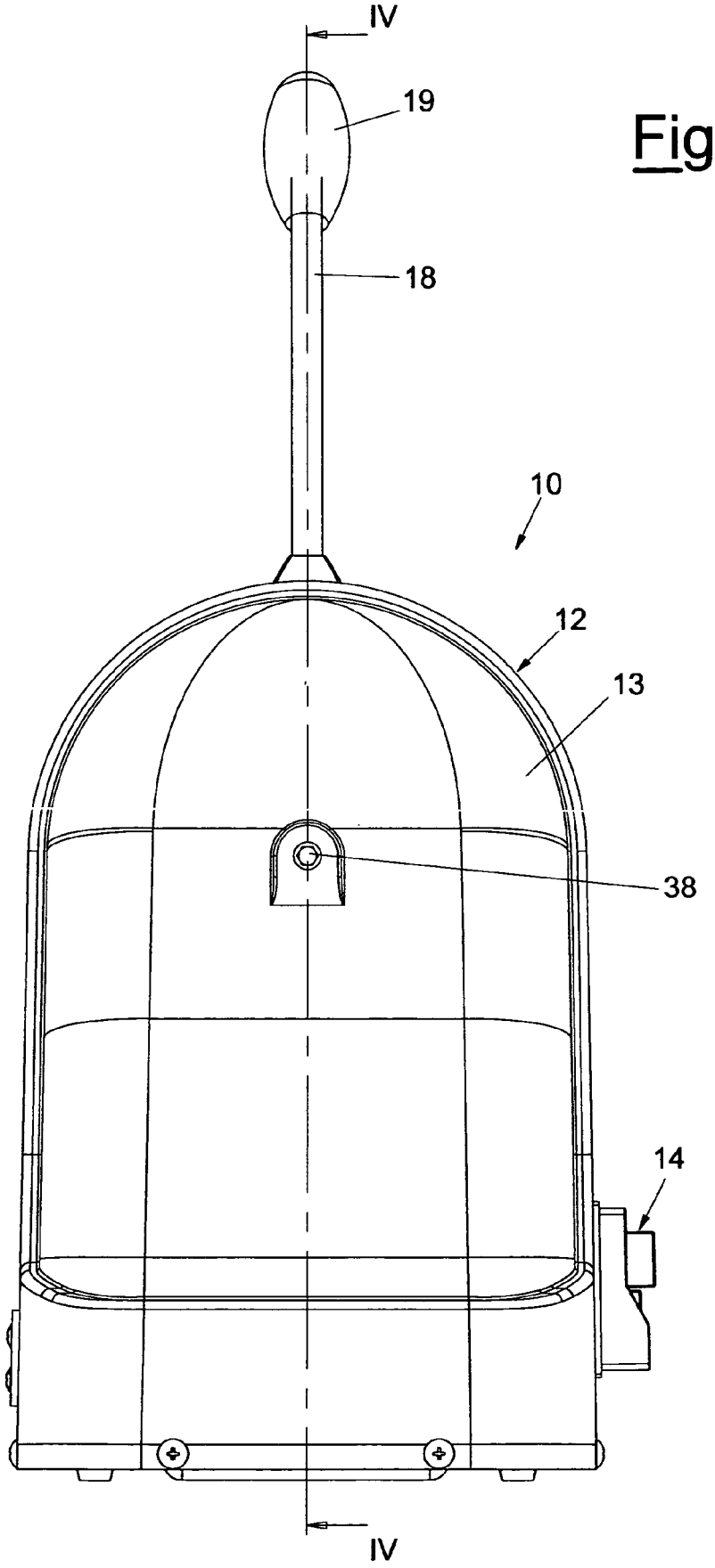
FIG. 3 is a rear view of the ice-crusher according to the present invention.

With reference to the drawings, the whole ice-crusher is indicated with numeral 10 and it comprises a front portion 11 for inserting ice and collecting the ice pieces and a rear portion 12 consisting of a shaped covering 13 for an area containing the cutting unit and the motor driving such a unit.

A switch 14 for putting the apparatus 10 on and off is placed on the covering 13, said covering 13 resting on a shaped base 41 which absorbs the mechanical stresses transmitted by the apparatus 10 while working.

The front portion 11 of the ice-crusher 10 comprises a grinding hole 15, normally made of melted aluminium, into which the ice (usually in the shape of cubes of various sizes) to be ground is inserted.

The hopper of the grinding hole 15 consists of a semicircle feeding collar 16 onto to the top of which a lever 18 is hinged by means of a block 17. Said lever 18 is provided with a shaped handle 19 which, through the motion of a shaped plate 22, permits to push the ice into the cutting unit (which is provided inside the ice-crusher 10 and is described in detail below).

The lever 18 is interlocked with a microswitch 20 which prevents the user from approaching the inner grinding unit while the motor of the ice-crusher 10 is working. The ice being broken into pieces of different thickness, consistency and size is released through an opening at the bottom 21 of the grinding hole 15 which, in prior embodiments of the ice-crusher 10, is provided with a protection grid to prevent the user from inserting the user's fingers into the working area.

Figure 4:
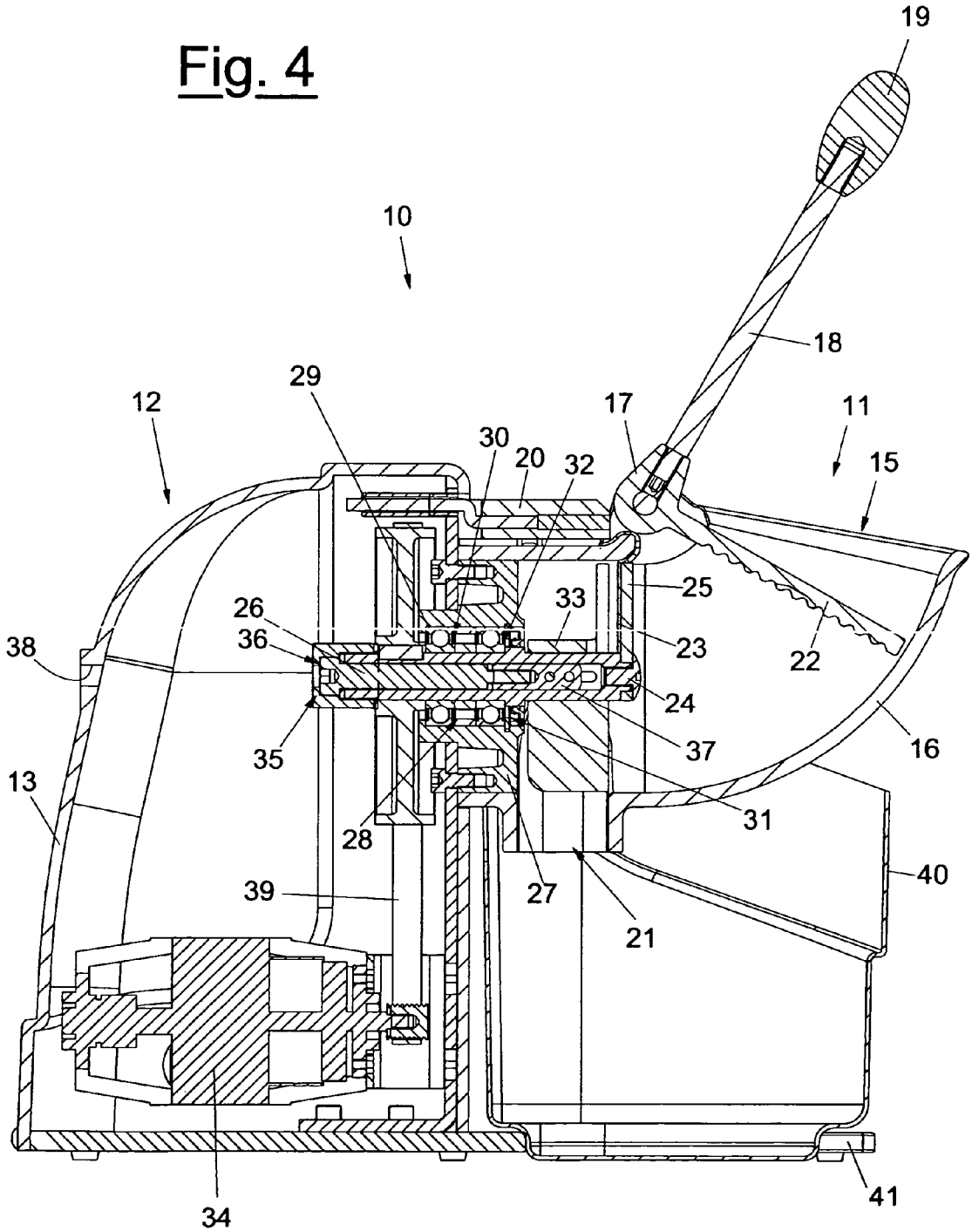
FIG. 4 is a sectional view taken along line IV-IV of FIG. 3.
Figure 5:
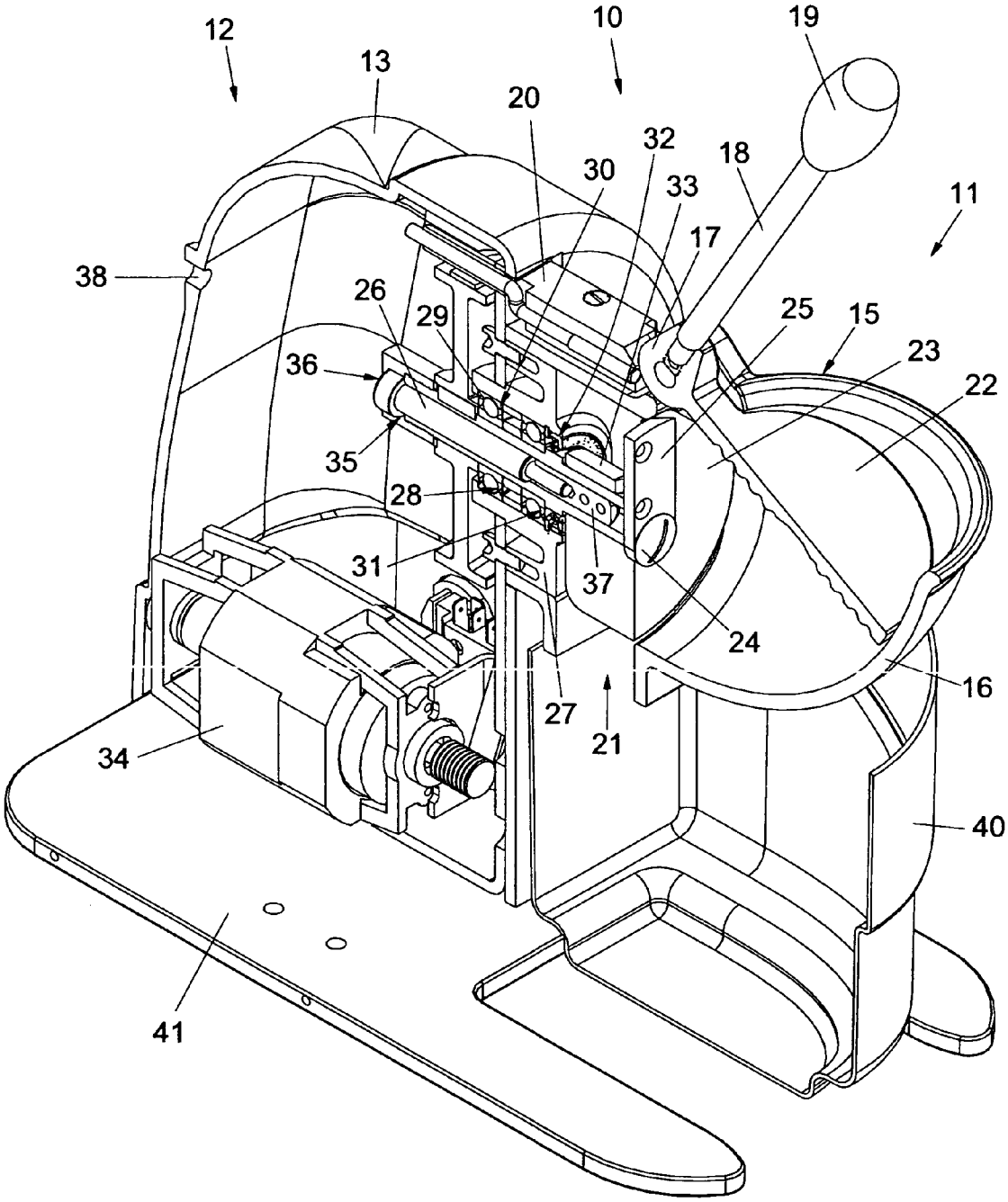
FIG. 5 is an axonometric cross-sectional view of the ice-crusher according to the present invention.
Figure 6:
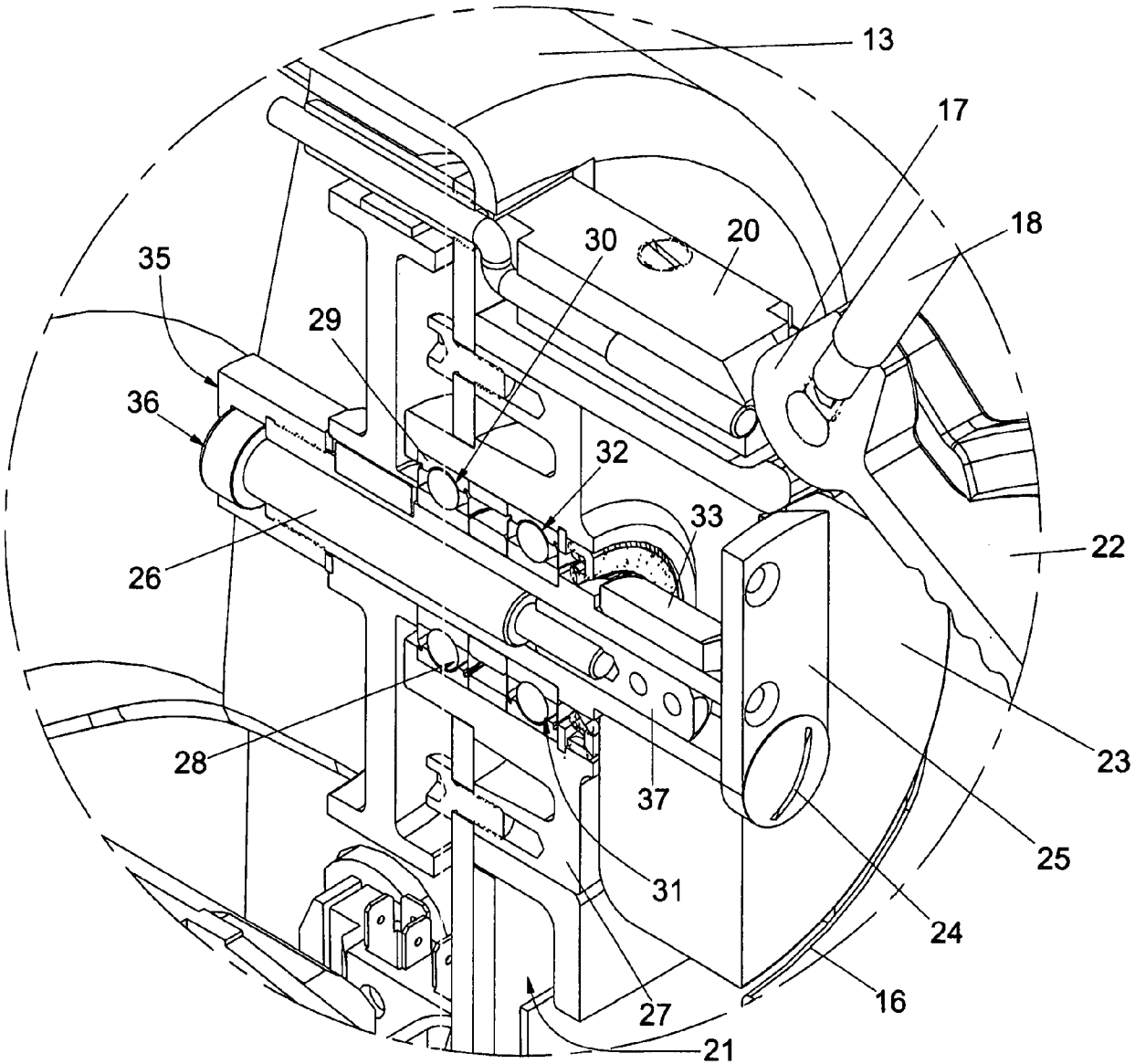
FIG. 6 shows an enlarged view of a detail of FIG. 5.
Figure 7:
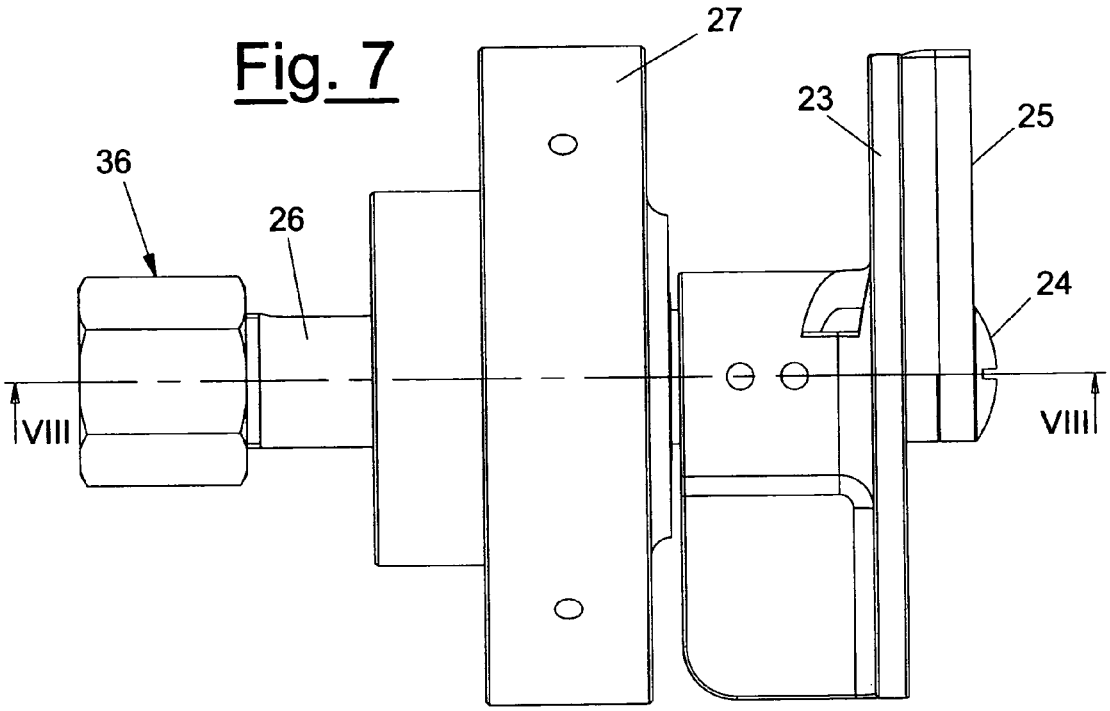
FIG. 7 is a schematic side view of the cutting unit used in the ice-crusher according to the present invention.
Figure 8:
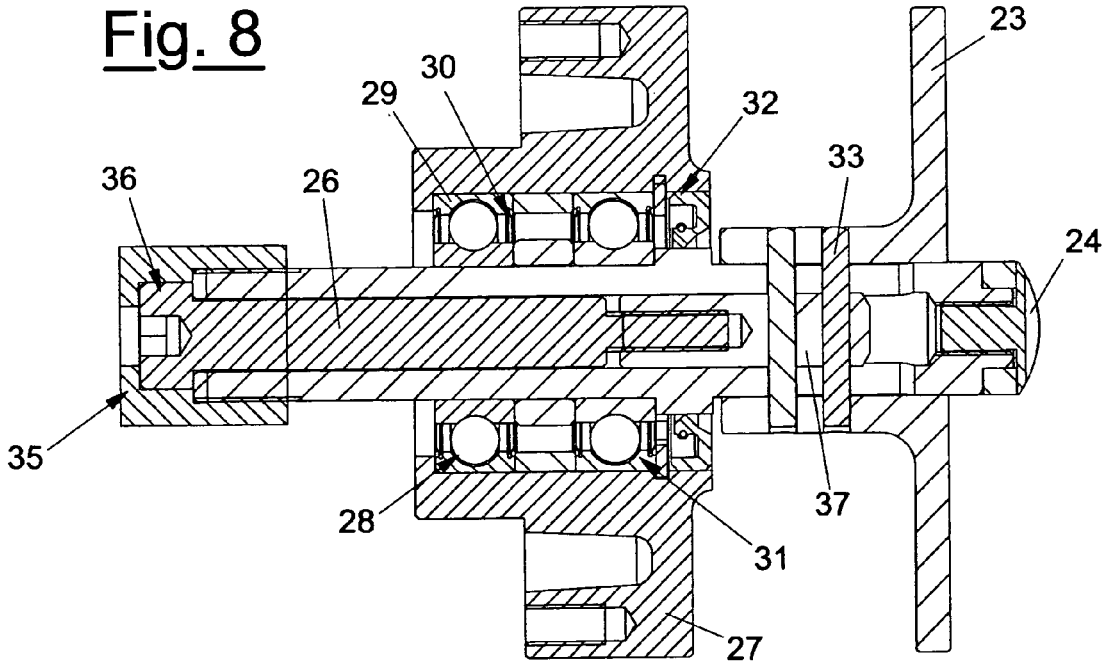
FIG. 8 is a sectional view taken along line VIII-VIII of FIG. 7.

With reference to FIGS. 4-8, which show the construction details of the ice-crusher 10 of the invention, the ice cutting unit includes a rotating disc 23 to which a cutting blade 25 is attached by means of fastening screw 24, said cutting blade 25 being integral with a driving shaft 26.

In particular, the above mentioned cutting unit comprises a flange 27 supporting the driving shaft 26 on which a plurality of bearings 28 is attached which are serially set up onto respective spacers 29, 30 of elastic safety and seal rings 31, 32.

The bearings 28 are set up adjacent to the driving shaft 26, while the disc 23 rotates integrally with the shaft 26 by inserting one or more cylindrical plug 33. According to the present invention, the distance of the rotating disc 23 from the blade 25 can be axially adjusted by the user simply by means of a key, without having to open the covering 13 of the ice-crusher 10.

In this regard, a horizontal motor 34 is provided inside the covering 13, said motor 34 being staggered relative to the working and/or driving shaft 26. The horizontal motor 34 also transmits motion to the rotating disc 23 by means of a belt 39, thus leaving room, on the upper portion and opposite the cutting blade 25, inside the covering 13 of the ice-crusher 10 for the user to operate on the device for regulating the thickness of the ground ice.

Such a regulating device comprises, in particular, a ring nut 35 locking the pulley of the driving shaft 26. Inside said ring nut 35 a thickness regulation screw 36 is provided which is integral with the driving shaft 26 and with a thickness regulation bush 37 which is adjacent to the cutting blade 25.

The operator can thus act on the screw 36 by means of a key from outside the covering 13 to regulate axially the distance of the disc 23 from the blade 25.

Such an operation can be easily carried out by the user due to the presence of the hole 38 on the covering 13 axially with respect to the regulation screw 36.

This arrangement also protects the motor 34 against the possible seepage of water from the cutting unit and against the mechanical stresses produced by the ice pieces being ground, which would compromise the motor life.

Finally, the rev reduction of the motor 34 on the driving shaft 26 by means of the belt 39 also permits to employ a manifold motor 34 (not an induction motor, as in conventional ice-crushers), with considerable operating advantages, such as a high number of revolutions (therefore, the rev reduction increases the torque transmitted to the driving shaft 26, thus increasing the effectiveness thereof), better self-cooling (for an even harder use of the motor 34), reduced dimensions as well as production and operating costs.

According to the invention, in the ice release area corresponding to the lower portion 21 of the feeding hole 15 a cup 40 is provided to collect the crushed product, such a cup also being interlocked with a microswitch, so that, by removing the cup, the ice-crusher 10, if turned on, automatically stops.

The use of the collecting cup 40 helps to release ice which, otherwise (as in conventional ice-crushers), tends to get stuck in the protection grid which is placed adjacent to the lower portion 21 of the hole 15. The characteristics of the ice-crusher of the present invention, as well as the advantages thereof become apparent from the above description.

Anyway, it is clear that several variations can be made to the ice-crusher of the invention, without thereby departing from the scope of the invention, and that, when practically carrying out the invention, the materials, shapes and dimensions of the illustrated details can vary according to the user's needs and be changed with other technically equivalent ones.

The invention claimed is:

1. An ice-crusher (10) comprising a grinding hole (15) which includes a feeding collar (16) to which a lever (18) is hinged to push ice towards a cutting and/or crushing unit, characterized in that said cutting and/or crushing unit includes at least a rotating disc (23) to which a cutting blade (25) is attached, wherein the distance of said cutting blade (25) from the rotating disc (23) can be set axially by the user in order to break up ice into pieces of different thickness and/or size wherein said cutting and/or crushing unit is driven by a driving shaft (26) which is connected with a manifold motor (34) by means of a belt (39) said motor (34) is positioned horizontally and is staggered relative to the driving shaft (26) to leave room for inserting from outside into an external covering (13) of the device (10) a tool for regulating the thickness of the ground ice in that said driving shaft (26) is locked in its position by a locking ring nut (35), inside of which is provided a thickness regulation means (36) which is integral with said driving shaft (26) and a thickness regulation bush (37) which is adjacent to the cutting and/or crushing unit, so that an operator can act on said thickness regulation means (36) with a regulation key from outside the covering (13) to regulate axially the distance of the rotating disc (23) from the cutting blade (25).

2. An ice-crusher (10) as claimed in claim 1, characterized in that said ice-crusher comprises a front portion (11) for inserting ice and collecting the ice pieces and a rear portion (12) covering an area containing the cutting and/or crushing unit and the motor (34) driving such a unit.

3. An ice-crusher (10) as claimed in claim 2, characterized in that grinding hole (15, into which ice to be ground is inserted is located in said front portion (11) of the device (10), said grinding hole (15) includes a hopper consisting of a semicircle feeding collar (16) having a hinged lever (18), said lever (18) being adapted to push the ice from the hole (15) into the cutting and/or crushing unit.

4. An ice-crusher (10) as claimed in claim 1, characterized in that said unit for cutting ice includes a rotating disc (23) to which the cutting blade (25), which is integral with said driving shaft (26), is attached by a fastening means (24).

5. An ice-crusher (10) as claimed in claim 4, characterized in that said cutting and/or crushing unit comprises a flange (27) supporting the driving shaft (26) on which a plurality of bearings (28) are mounted between respective spacers (29, 30) and elastic safety and seal rings (31, 32), said bearings (28) being set up adjacent to the driving shaft (26) and said rotating disc (23) being positioned to rotate integrally with the driving shaft (26) by a pin (33).

6. An ice-crusher (10) as claimed in claim 1, characterized in that a hole (38) for inserting said regulation key is provided on the external covering (13) of the apparatus (10) axially with respect to said thickness regulation means (36).

* * * * *